United States Patent [19]

Seo

[11] 3,949,588

[45] Apr. 13, 1976

[54] STRAIGHTENING PRESS FOR ROD-LIKE WORKPIECE

[75] Inventor: Naonori Seo, Nagoya, Japan

[73] Assignee: Towo Seiki Co. Ltd., Nagoya, Japan

[22] Filed: Dec. 9, 1974

[21] Appl. No.: 531,034

[30] Foreign Application Priority Data

Dec. 28, 1973 Japan ..... 49-590
Dec. 28, 1973 Japan ..... 49-1198[U]

[52] U.S. Cl. ..... 72/389; 72/12
[51] Int. Cl.[2] ..... B21D 3/10
[58] Field of Search ..... 72/389, 385, 386, 453, 72/10, 11, 12

[56] References Cited

UNITED STATES PATENTS

| | | | |
|---|---|---|---|
| 525,003 | 8/1894 | Copley | 72/389 |
| 2,726,703 | 12/1955 | Fultz | 72/386 |
| 2,748,829 | 6/1956 | Korenak | 72/389 |
| 2,765,836 | 10/1956 | Niekelski | 72/389 |
| 3,146,819 | 9/1964 | Van Endert | 72/389 |
| 3,335,587 | 8/1967 | Blachut | 72/10 |

FOREIGN PATENTS OR APPLICATIONS

| | | | |
|---|---|---|---|
| 230,302 | 3/1944 | Switzerland | 72/389 |

*Primary Examiner*—C. W. Lanham
*Assistant Examiner*—Gene P. Crosby

[57] ABSTRACT

Provided is a straightening press for a rod-like workpiece which is supported on a carrier sliding on a stationary base table. A plurality of detection units are disposed at intervals along the longitudinal direction of the workpiece. Each detection unit is provided with a sliding member sliding between the detection position for permitting a sensing element to contact the outer periphery of the workpiece and the retirement position for permitting said sensing element to be released from contact with said outer periphery, and said sensing element is provided on one end portion of a lever rockably supported by said sliding member, and the operating plunger of a differential transformer engages the other end portion of said lever.

12 Claims, 7 Drawing Figures

STRAIGHTENING PRESS FOR ROD-LIKE WORKPIECE

BACKGROUND OF THE INVENTION

This invention relates to a straightening machine, and more particularly to a straightening press for correcting the strain of a rod-like workpiece such as a shaft generally used with various types of machines.

In the conventional straightening press, an expert in the art measures the degree of strains at the respective portions of the rod-like workpiece set to the straightening press and manually move said respective portions up to the lowered position of ram, i.e., the pressing position of the workpiece, thereby to correct the workpiece strain. Accordingly, in most cases, the straightening operation requires an expert's own experierience and sense in order to elevate the straightening efficiency.

SUMMARY OF THE INVENTION

The object of the invention is to provide a straightening press suited for automatization of the straightening operation steps beginning with the detection step for detecting the strain of a rod-like workpiece and ending in the step for correcting such stain and capable of efficiently treating a large number of workpieces with uniform precision without an expert's own experience and sense.

For attaining the above object, the straightening press according to the invention is constructed as follows. That is, the step wherein a carrier or work table, onto which the workpiece is applied, is moved relatively to a stationary base table thereby to longitudinally position the workpiece is carried out by an oil hydraulic cylinder; the step wherein a pair of receiving blocks, on which the workpiece is set, are moved on the carrier thereby to longitudinally position the workpiece is carried out by another oil hydraulic cylinder; and the step wherein the workpiece is rotated about the axial line thereof and thereby positioned in the rotation direction of the workpiece is carried out by a pulse motor. Said oil hydraulic cylinders and pulse motor are selectively operated under the control of an electronic computer thus to enable the straightening press to be automatized.

Further, the straightening press according to the invention is so constructed that a strain detection mechanism for detecting the degree of workpiece strain is automatically set to the workpiece only at the time of strain detection and is normally retired up to the position for permitting the ram-pressing operation to be performed without hindrance. For this reason, the vibration of workpiece due to the pressing operation is prevented from being transmitted to said strain detection mechanism to remove the drawback of the detection mechanism being functionally deteriorated dut to the workpiece vibration. Further, the strain detection can be conducted at an increased number of positions along the longitudinal direction of the workpiece.

Further, the downward stroke of pressing ram is automatically determined in accordance with the degree of workpiece strain as measured by said strain detection mechanism. Accordingly, excess or shortage of the workpiece pressing force of the ram can be avoided to enable the straightening operation to be quickly carried out with high efficiency.

DESCRIPTION OF THE PREFERRED EMBODIMENT

Figure 1:
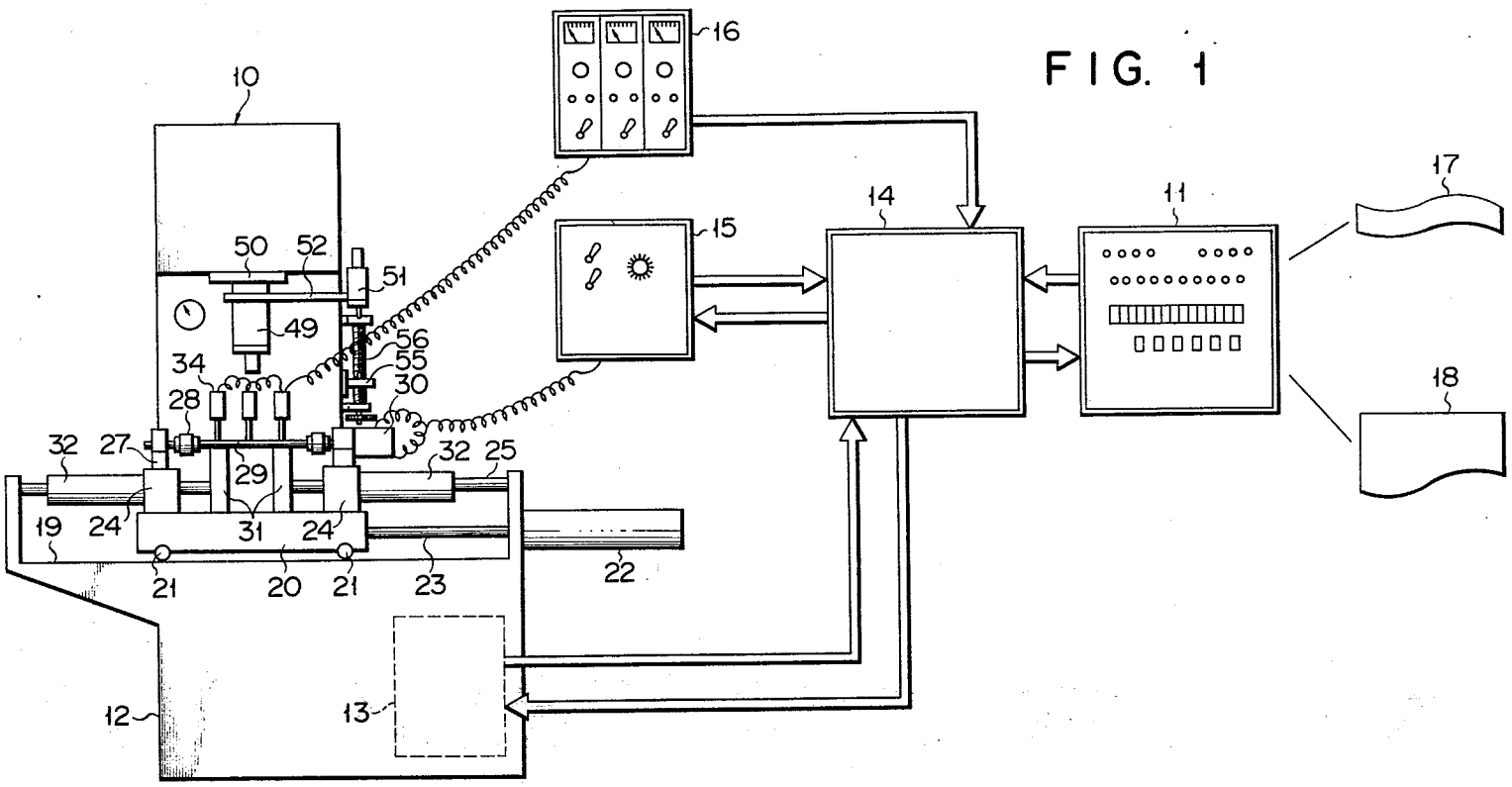
FIG. 1 illustrates the operational manner in which a schematically shown straightening press according to an embodiment of the invention is associated with a small-sized electronic computer.
Figure 2:
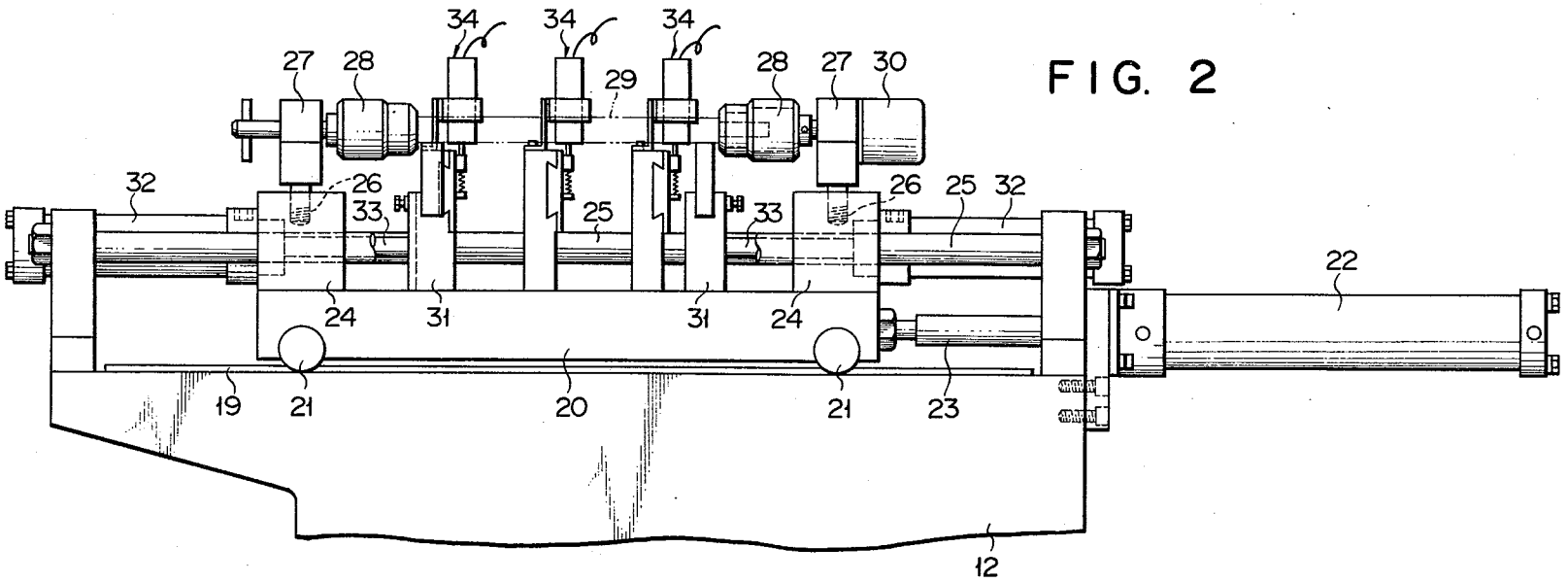
FIG. 2 is an enlarged front view of the main part of the straightening press illustrated in FIG. 1, in which particularly the carrier mounted on the stationary base table is shown in detail.
Figure 3:
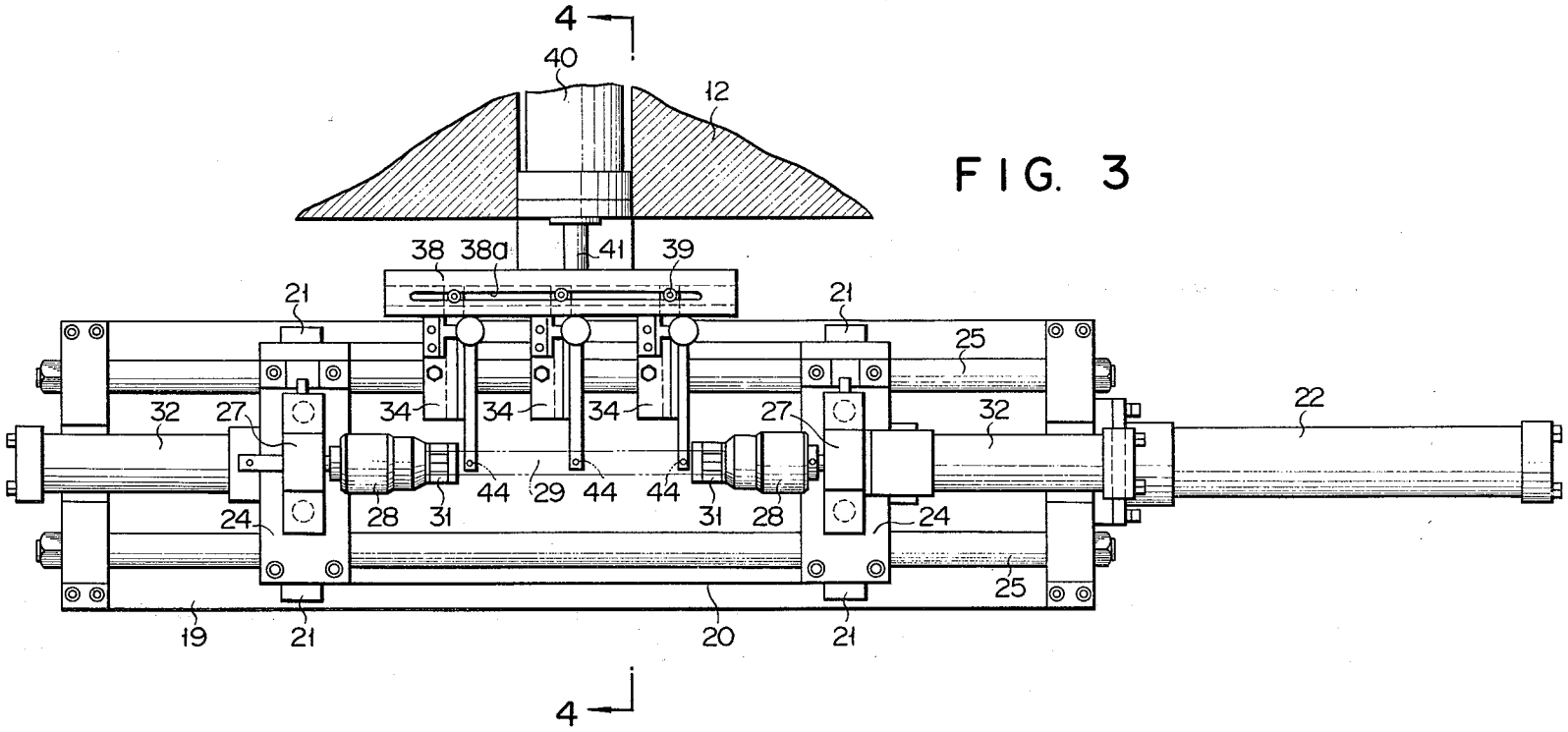
FIG. 3 is a plan view of FIG. 2.

In FIG. 1 there is illustrated the construction of a straightening press 10 according to the invention so connected to a small-sized electronic computer 11 as to be controlled thereby. A control box 13 indicated by a broken line disposed within the machine frame 12 of the straightening press 10 is electrically connected to the computer 11 through an interphase device 14. A pulse motor controller 15 is provided for the purpose of controlling the operation of two pulse motors 30 and 59 as later described provided for the straightening press 10 and is electrically connected to the computer 11 through the interphase device 14. A measuring device 16 is electrically connected to respective operating transformers 47 set on detection units 34 as later described provided for the press 11 and is electrically connected to the computer 11 so as to permit a measurement valve signal transmitted from the respective transformers 47 into the measuring device 16 to be supplied into the computer 11 through the interphase device 14. The computer 11 can beforehand be supplied, by a press handling operator, with these information items from a tape 17 or typewriter 18 which are necessary to detect the strain degree of shaft or rod-like workpiece.

On a stationary base table 19 provided on the machine frame 12 of the straightening press 10 there is mounted a carrier 20 longitudinally movable on the table 19. To the carrier 20 are attached a plurality of rollers 21, by means of which the carrier 20 is permitted to roll on the table 19. As means for driving the carrier 20 an oil hydraulic cylinder 22 is provided for the table 19, and the free end of rod 23 of the cylinder 22 is secured to one end of the carrier 20. Onto both end portions of the carrier 20 are respectively secured a pair of block members 24, through which are inserted two parallel guide rods 25, each of which is fixed at both ends to the machine frame 12. On the paired block members 24 are respectively mounted a pair of support members 27 with compression springs 26 respectively interposed therebetween. To the support members 27 are respectively rotatably attached chuck members 28, by which are grasped both end portions of the workpiece. As means for rotating one chuck member 28 a pulse motor 30 is connected to said one chuck member, and said pulse motor 30 is mounted onto the support member 27. The pulse motor 30 is associated with the above-mentioned pulse motor controller 15 and, upon receipt of a command signal from the controller 15, causes the chuck member 28 to rotate the workpiece 29 through a prescribed angle. Between said paired support members 27 a pair of receiving blocks 31 are disposed on the carrier 20 so as to move in the travelling direction of the carrier 20 relatively to the carrier 20. To the receiving blocks are respectively secured the free ends of rods 33 of oil hydraulic cylinders 32 attached to the respective block members 24. Accordingly, by operation of the oil hydraulic cylinders 32 the respective receiving blocks 31 can be moved to a given position on the carrier 20. For this reason, the span between the paired receiving block 31 can properly be varied. The upper surface of the paired receiving block 31 is formed into a substantially V-shape, and the workpiece 29 is received in the V-shaped surface.

Figure 4:
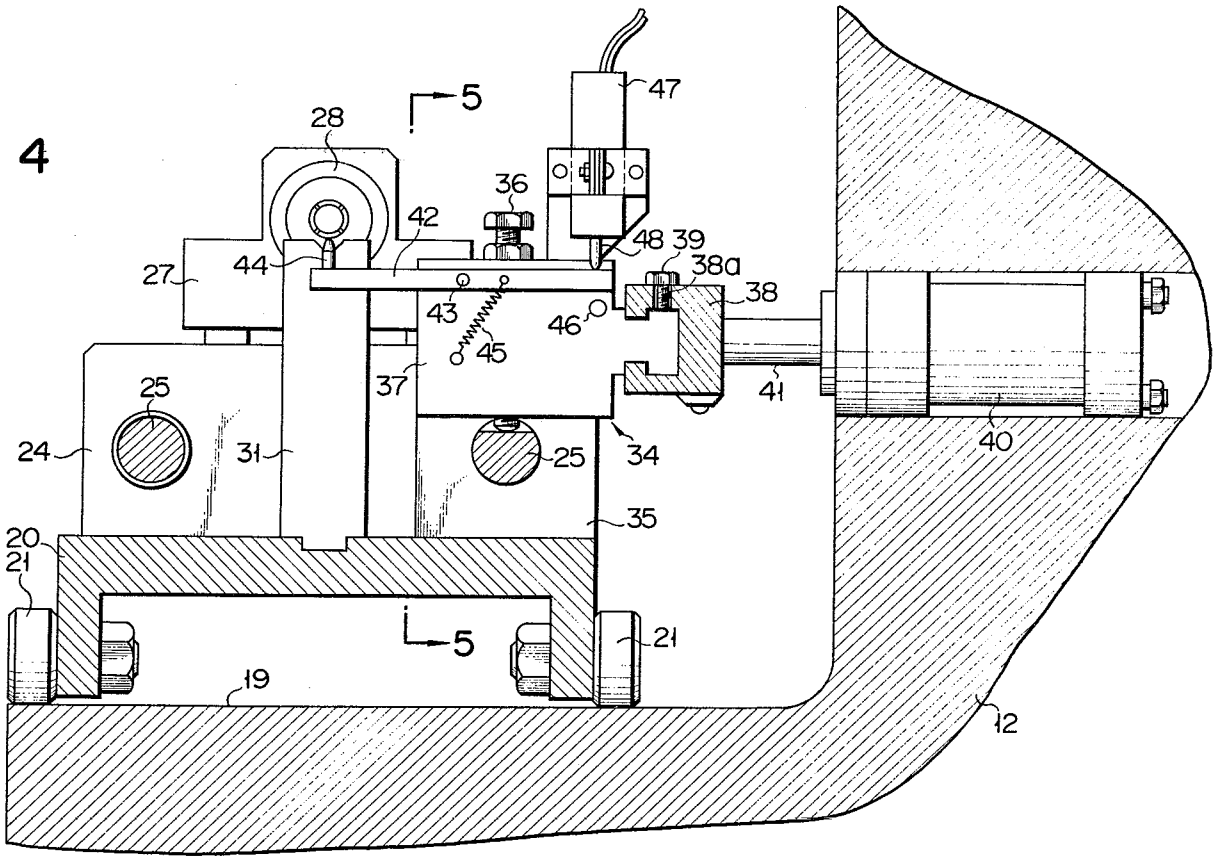
FIG. 4 is an enlarged cross sectional view taken along line 4—4 of FIG. 3.

Three detection units 34 are disposed on the carrier 20 along one edge of the rearward end portion thereof. The base supports 35 of the respective detection units are disposed at prescribed intervals in parallel with each other, and one of said guide rods 25 is inserted through the base supports 35. Accordingly, the respective base supports 35 are rendered slidable by the guide rod 25 on the carrier 20 in the travelling direction of the carrier 20 relatively to the carrier 20. The respective base supports 35 are normally fixed by bolts 36 to the guide rods 25 so as not to make a sliding movement as illustrated in FIG. 4. Sliding members 37 are each fitted to one side surface of each base support 35 by engagement of a groove **35*a* with a projection 37*a*. The respective sliding members 37 are slidable crosswise to the travelling direction of the carrier 20 relatively to the base support 35. The rearward end portions of the respective sliding members 37 are slidably engaged with the recess of a connection member 38, and the sliding direction of the sliding members 37 is in parallel with the travelling direction of the carrier 20. The sliding movement is guided by bolts 39 fixed to the respective sliding members 37 and a lengthy groove 38*a* formed in the connection member 38 and engaged with the bolts 39. To the connection member 38 is secured the free end of rod (or plunger) 41 of an oil hydraulic cylinder 40 attached rearwardly of the machine frame 12. That is to say, the cylinder 40 constitutes power-driving means for driving the sliding members 37 so as to permit the same to slide relatively to the base supports 35 through the connection member 38**.

The respective foregoing oil hydraulic cylinders 22, 32, 40 as the power-driving means are connected to the control box 13 and are selectively operated in accordance with the control signals from said box 13.

At the side surface of said sliding member 37 a lever 42 is rockably supported by a pivot pin 43. To the tip end of forward arm of the lever 42 is secured a sensing element or projection 44. The lever 42 is so biased by a spring 45 as to be rocked about the pivot pin 43 in the clockwise direction of FIG. 4. A stop pin 46 projectively provided at the side surface of the sliding member 37 holds the lever 42 at a desired position against the action of the spring 45. The tip end of the backward arm of the lever 42 corresponds to the differential transformer 47 attached onto the base support 35 as as to permit the operating plunger 45 of the differential transformer 47 to abut against the tip end of said backward arm. The respective differential transformers 47 are electrically connected to the measuring instrument 16 as previously mentioned.

That position of the sliding members 37 which is illustrated in FIG. 4 is the workpiece detection position of the sliding members 37, and the respective sliding members 37 are retired by the operation of the cylinder 40 toward the right of FIG. 4 and thereby moved up to a prescribed retirement position. When the sliding members 37 are situated at the detection position, each sensing element 44 is in abutment with the outer periphery of the rod-like workpiece 29 held in place by the pair of chuck members 28. The sensing element 44 is vertically displaced by an extent corresponding to the amount of workpiece strain at the abutment portion of the workpiece against the sensing element to cause the lever 42 to be rocked by an extent corresponding to the amount of sensing element displacement. Accordingly, the operating plunger 48 contacting with the backward arm of the lever 42 is upwardly moved by an extent corresponding to said amount of sensing element displacement, so that the amount of plunger movement is converted by the differential transformer 47 into an electrical value and this electrical measurement value is transmitted to the measuring device 16. Namely, the respective differential transformers 47 constitute conversion means for converting the amount of sensing element displacement corresponding to the amount of workpiece strain into an electrical amount of displacement.

Above the carrier 20 is disposed a ram 49 vertically movably supported by the machine frame 12. This ram is connected to an oil hydraulic cylinder 50 vertically provided within the machine frame 12 and is driven by the cylinder 50. By the driving operation of the cylinder 50 the ram 49 is lowered vertically from its prescribed raised position toward the central position of the stationary table 19 to abut against the workpiece 29, thereby pressing the workpiece 29 in cooperation with the paired receiving block 31 to correct the strain of the workpiece 29. The position at which the workpiece 29 is pressed by the ram 49 optionally varies in accordance with the travelling movement of the carrier 20 on the table 19. The oil hydraulic cylinder 50 for driving the ram 49 is also connected to the control box 13.

Figure 7:
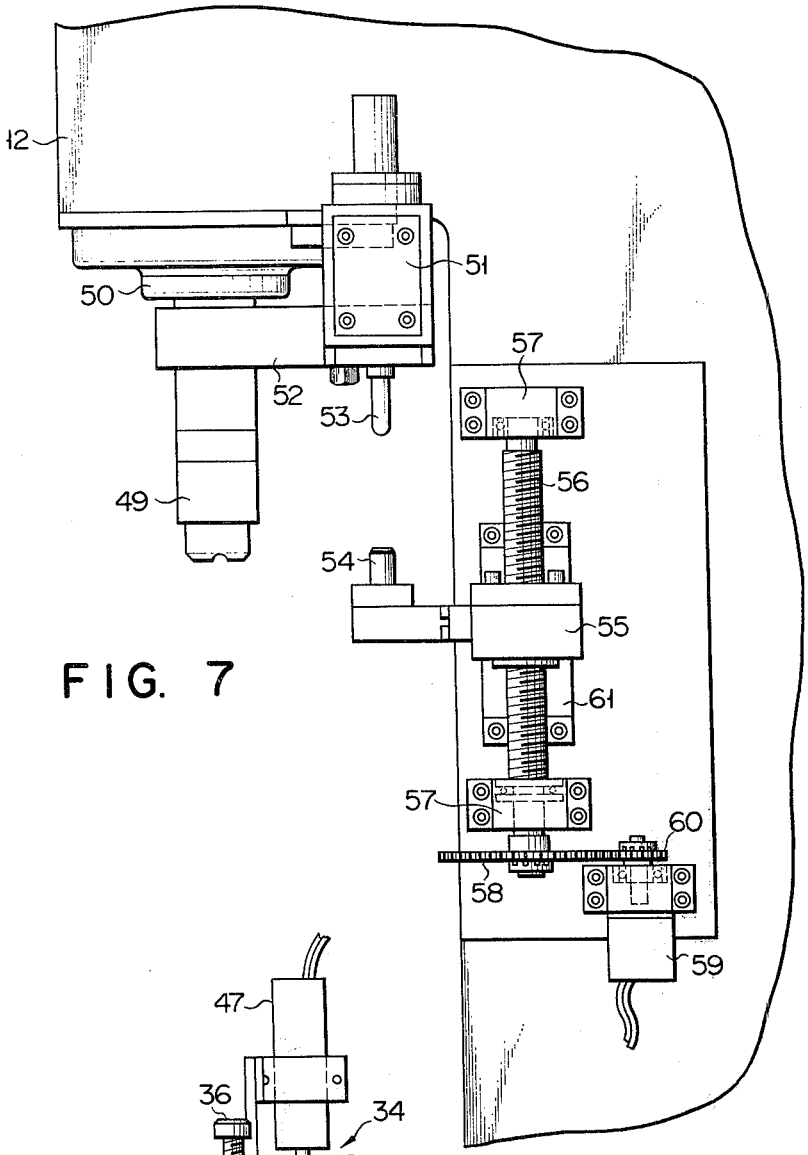
FIG. 7 is a side view of FIG. 6.
Figure 5:
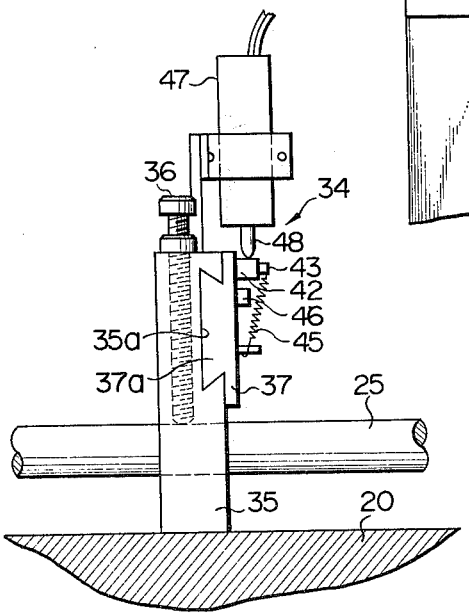
FIG. 5 is a partial sectional view taken along line 5—5 of FIG. 4.
Figure 6:
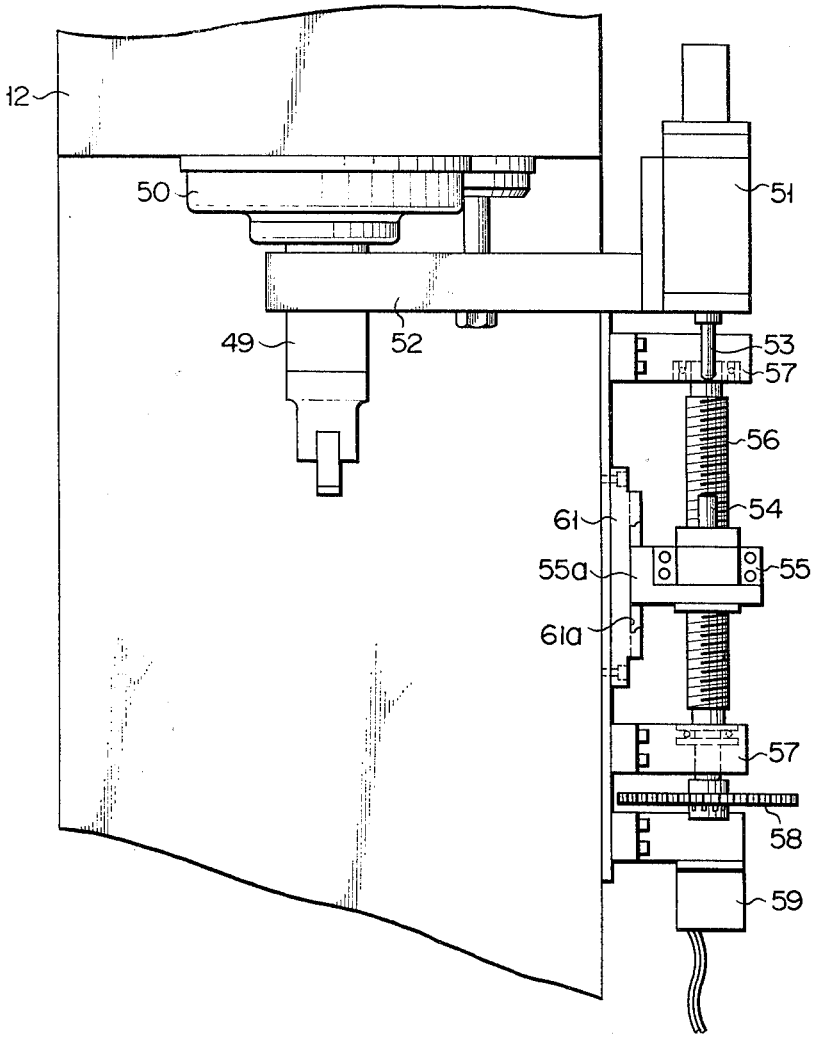
FIG. 6 is an enlarged front view of the main part of the straightening press illustrated in FIG. 1, in which particularly a mechanism for adjusting the downward stroke of ram is shown in detail.

In an adjustment mechanism for adjusting the downward stroke of ram illustrated in FIGS. 6 and 7, a valve 51 is provided for the ram 49 in a manner that said valve 51 is supported by a beam member 52 so as to make a vertical movement together with the ram. This valve 51 has a plunger 53. In the path through which the valve 51 is lowered, a stop pin 54 is disposed below the valve 51 and secured to a support block 55. When the valve 51 is lowered jointly with the ram 49 to cause the plunger 53 to abut the stop pin 54, the valve 51 is so operated as to stop the operation of the ram driving cylinder 50. That is, the valve 51 constitutes first stop means for determining the downward stroke of ram and the stop pin 54 and the support block 55 constitute second stop means for the same purpose.

Said support block 55 is fitted over a vertically arranged feed screw shaft 56 by screw engagement. The upper end portion and the proximity of the lower end portion of the feed screw shaft 56 are supported by the machine frame 12 through bearing members 57, respectively, so as to permit the shaft 56 to be rotated. By rotation of the screw shaft 56 the support block 55 is vertically moved along the screw shaft 56 to permit the stop pin 54 to be located at a proper position in the falling path of the valve as the first stop means. A gear 58 is secured to the lower end of said feed screw shaft 56. By a pulse motor 59 secured to the machine frame 12, a pinion 60 is rotated. This pinion 60 is intermeshed with the gear 58. Accordingly, the rotation of the motor 59 is transmitted through the gear 58 and the pinion 60 to the screw shaft 56 in a manner that said rotation of the motor 59 is reduced in speed. That is, the feed screw shaft 56, gear 58, pinion 60, and pulse motor 59 constitute power-driving means for executing the operation of the second stop means.

The pulse motor 59 is electrically connected to a pulse motor controller 15 and is adapted to be intermittently rotated through each prescribed angle in accordance with a prescribed command signal from the controller 15. In accordance with the intermittent rotation of the pulse motor 59 the feed screw shaft 56 causes the second stop means to be moved to a prescribed position, thereby determining the downward stroke of ram.

To the machine frame 12 is secured a guide member 61. In the guide member 61 is provided an elongated groove 61*a* vertically formed. With the groove 61*a* is engaged a protruded section 55*a* formed on the support block 55. When the screw shaft 56 is rotated, the support block 55 is prevented from being rotated about the shaft 56, by the engagement of the groove 61*a* with the protruded section 55*a.* Accordingly, the support block 55 is permitted to make only a vertical movement.

There will now be described the operations of strain detection and strain correction of the rod-like workpiece 29 in the straightening press 10 having the foregoing construction.

The respective detection units 34 are moved up to a prescribed detection position so as to permit the three sensing elements 44 to abut against the outer periphery of the workpiece 29 grasped by the pair of chuck members 28. The driving of these detection units 34 is of course effected by the cylinder 40 as previously mentioned. The workpiece 29 is rotated by the pulse motor 30, thereby indicating that portion of the workpiece 29 with which is contacted one of the sensing elements 44 presenting the maximum amount of displacement. That is, said portion of the workpiece 29 indicates the maximum amount of workpiece strain. As previously mentioned, the respective mechanical amounts of sensing element displacements are converted into electrical amounts of displacements by the differential transformers 47 provided correspondingly to the respective elements, and the electrical signals corresponding to the electrical amounts of displacements are transmitted into the measuring device 16. The electronic computer 11 controls the rotation of the pulse motor 30 in accordance with the information from the measuring device 16 to stop the workpiece rotation at the position in which the workpiece portion indicating the maximum amount of strain is turned upward.

Thereafter, the carrier 20 is driven by the cylinder 22 and is so moved as to permit said workpiece portion indicating the maximum amount of strain to be just brought to the lowered position of the ram 49, i.e., the pressing position of the workpiece 29. Simultaneously, the three detection units 34 are retired at one time to cause the respective sensing elements 44 to be released from contact with the workpiece 29.

The downward stroke of ram 49 is previously determined by the adjustment mechanism illustrated in FIGS. 6 and 7 in accordance with the strain degree of the workpiece portion set to the pressing position. The ram 49 is lowered by the driving operation of the cylinder 50 from the raised position to abut the workpiece, thereby pressing the workpiece in cooperation with the paired receiving blocks 31 to straighten the workpiece portion presenting the maximum amount of strain.

By repeatedly performing the foregoing operation several times under the control of the electronic computer 11 the workpiece strain can be so corrected as to have a degree lower than desired.

The preceding embodiment referred to the case where the detection units were provided in a number of 3, but the detection unit number can optionally be determined in accordance with the workpiece length, the workpiece precision desired to be determined, and the like.

I claim:

1. A straightening machine for rod-like workpiece comprising a machine frame, a stationary base table provided on said machine frame, a carrier longitudinally rollable on said stationary table, means for supporting the workpiece on said carrier, workpiece strain detection unit transversely movable on the carrier, said detection unit including a sensing element allowed to contact the workpiece for sensing the degree of workpiece strain, and power-driving means for permitting the detection unit to be moved, only at the time of detecting the degree of workpiece strain, from a retirement position at which said sensing element is out of contact with the workpiece to a detection position at which said sensing element contacts the workpiece.

2. A straightening machine for rod-like workpiece comprising a machine frame, a stationary base table provided on said machine frame, a carrier longitudinally rollable on said stationary base table, means for rotatably grasping both end portions of the workpiece on the carrier, workpiece strain-detection unit for detecting the degree of workpiece strain including a sensing element allowed to contact the workpiece and a support member for supporting said element, a block member slidably engaged with said support member in groove-projection relationship so as to move said detection unit transversely with respect to the travelling direction of the carrier and longitudinally slidable on the carrier so as to move said detection unit substantially in parallel with the lengthwise direction of the workpiece, and power-driving means for permitting the detection unit to be transversely moved, only at the time of detecting the degree of workpiece strain, from a retirement position at which said sensing element is out of contact with the workpiece to a detection position at which said sensing element contacts the workpiece.

3. A straightening press for rod-like workpiece comprising a machine frame, a ram vertically movably supported by said machine frame and normally held at a raised position, ram driving means for lowering said ram from said raised position to a pressing position for pressing the workpiece, a stationary base table provided on said machine frame, a carrier longitudinally rollable on said table, means provided on said carrier for rotatably grasping both end portions of the workpiece, supporting means for supporting the workpiece on the carrier, workpiece strain-detection means including a sensing element allowed to contact the outer periphery of the workpiece for sensing the degree of workpiece strain and movable on the carrier in a direction substantially at right angles with respect to the travelling direction of the carrier, and power-driving means for permitting said detection means to be moved, only at the time of detecting the degree of workpiece strain, from a retirement position at which said sensing element is out of contact with the workpiece to a detection position at which said sensing element contacts the workpiece and returning said detection means from said detection position to said retirement position in advance of the operation for pressing the workpiece by the ram in accordance with the operation of said ram driving means.

4. A straightening press according to claim 3, further comprising an adjustment mechanism for adjusting the downward stroke of ram from said raised position including first stop means so cooperated with said ram as to be lowered together therewith, second stop means vertically movably provided for the machine frame so as to be located below said first stop means in the falling path for the same and, when the ram is lowered from said raised position, abutting against the first stop means thereby to determine the downward stroke of ram, and power-driving means for permitting said second stop means to be moved so as to be set to any desired position.

5. A straightening press for rod-like workpiece comprising a machine frame, a ram vertically movably supported by said machine frame and normally held at a raised position, ram driving means for lowering said ram from said raised position to a pressing position for pressing the workpiece, a stationary base table provided on said machine frame, a carrier longitudinally rollable on said table, carrier driving-power means for permitting said carrier to make a rolling movement, means for grasping both end portions of the workpiece rotatably about the axial line of the workpiece, workpiece driving-power means for permitting the workpiece to be selectively rotated about the axial line thereof, a plurality of receiving blocks for receiving the workpiece and, when said ram presses the workpiece, straightening the workpiece in cooperation with said ram, receiving block driving means for permitting respective said receiving blocks to longitudinally slide on the carrier relative thereto to vary the distance between the respective receiving blocks, a plurality of detection units for detecting the degree of workpiece strain each including a sliding member slidable on the carrier substantially at right angles with respect to the axial line of the workpiece, a lever rockably mounted onto said sliding member and rocked through an angle proportional to the amount of sensing element displacement made in accordance with the strain of the workpiece, said lever having at one arm a sensing element allowed to contact the outer periphery of the workpiece, and electrical conversion means having an operating plunger engaged with the other arm of said lever to convert the amount of sensing element displacement into an electrical amount of displacement, and detection unit driving-power means for permitting the respective sliding members of the detection units to slide, only at the time of detecting the degree of workpiece strain, from a normal retirement position at which said sensing element is out of contact with the workpiece to a detection position at which said sensing element contacts the workpiece.

6. A straightening press according to claim 5, further comprising block members provided on the carrier each for supporting the sliding member of each said detection unit so as to move each detection unit substantially in parallel with the axial line of the workpiece thereby to vary the distance between the detection units.

7. A straightening press according to claim 6, wherein sliding of each sliding member is achieved by engagement of said each sliding member with the corresponding block member in groove-projection engaging relationship.

8. A straightening press according to claim 5, further comprising a spring stretched between the sliding member and said lever for urging the lever so as to rock the same in a direction in which said sensing element is brought into contact with the outer periphery of the workpiece, and stop means provided between the sliding member and the lever for limiting the rocking movement of said lever in said direction thereof against the urging action of said spring.

9. A straightening press according to claim 5, further comprising an adjustment mechanism for adjusting the downward stroke of ram from said raised position including first stop means so cooperated with said ram as to be lowered together therewith, second stop means vertically movably provided for the machine frame so as to be located below said first stop means in the falling path for the same and, when the ram is lowered from said raised position, abutting against the first stop means thereby to determine the downward stroke of ram, and power-driving means for permitting said second stop means to be moved so as to be set to any desired position.

10. A straightening press according to claim 9, wherein said second stop means includes a stop pin located in the falling path for said first stop means to abut the same and a support block for supporting said stop pin; and said power-driving means includes a feed screw shaft vertically supported by the machine frame and fitted into said support block by screw engagement to permit a vertical movement of the support block through its own rotation and a pulse motor operatively connected to said screw shaft for intermittently rotating the screw shaft.

11. A straightening press according to claim 10, further comprising a guide member fixed to said machine frame and engaged with said support block in groove-projection relationship to prevent rotation of the support block despite the rotation of said feed screw shaft, thereby to permit only a vertical movement of the support block.

12. A straightening press for rod-like workpiece comprising a machine frame, a ram vertically movably supported by said machine frame and normally held at a raised position, a first oil hydraulic cylinder provided on said machine frame for lowering said ram from said raised position to a pressing position for pressing the workpiece, a stationary base table provided on said machine frame, a carrier longitudinally rollable on said table, a second oil hydraulic cylinder provided on said machine frame for permitting said carrier to make a rolling movement, a pair of chuck members for grasping both end portions of the workpiece rotatably about the axial line thereof, a pulse motor mounted on said carrier for permitting the workpiece to be rotated about the axial line thereof, a pair of receiving blocks for receiving the workpiece and, when said ram presses the workpiece, straightening the workpiece in cooperation with said ram, a pair of third oil hydraulic cylinders provided on said carrier and respectively connected to said pair of receiving blocks so as to permit the respective receiving blocks to longitudinally slide on said carrier thereby to vary the interval between both the receiving blocks, a plurality of base supports slidable on said carrier substantially in parallel with the axial line of the workpiece, a plurality of detection units for detecting the degree of workpiece strain each including a sliding member supported by each said base support through a groove-projection engagement and slidable substantially at right angles to the axial line of the workpiece, a lever rockably pivoted at its intermediate portion to said sliding member and rocked through an angle proportional to the amount of sensing projection displacement made in accordance with the strain of the workpiece, said lever having a sensing projection supported by one arm of said lever to be allowed to contact the outer periphery of the workpiece, and a differential transformer having an operating plunger engaged with the other arm of said lever to convert the amount of sensing projection displacement into an electrical amount of displacement, and a fourth oil hydraulic cylinder for permitting the sliding member of each detection unit to slide, only at the time of detecting the degree of workpiece strain, from a normal retirement position at which said sensing projection is out of contact with the workpiece to a detection position at which said sensing projection contacts the workpiece.

* * * * *

UNITED STATES PATENT AND TRADEMARK OFFICE

CERTIFICATE OF CORRECTION

PATENT NO. : 3,949,588
DATED : April 13, 1976
INVENTOR(S) : Naonori Seo

It is certified that error appears in the above-identified patent and that said Letters Patent are hereby corrected as shown below:

In the heading under Assignee, change Towo Seiki Co., Ltd. to Towa Seiki Co., Ltd.

Signed and Sealed this

Fourteenth Day of September 1976

[SEAL]

*Attest:*

RUTH C. MASON
*Attesting Officer*

C. MARSHALL DANN
*Commissioner of Patents and Trademarks*